United States Patent [19]

Strozewski

[11] 4,045,030

[45] Aug. 30, 1977

[54] CHESS GAME APPARATUS

[76] Inventor: Casimir S. Strozewski, 2526 N. Santiago, Santa Ana, Calif. 92706

[21] Appl. No.: 672,161

[22] Filed: Mar. 31, 1976

[51] Int. Cl.[2] ..... A63F 3/02

[52] U.S. Cl. ..... 273/131 AB; 273/131 F

[58] Field of Search ..... 273/131

[56] References Cited

U.S. PATENT DOCUMENTS

| | | | |
|---|---|---|---|
| 529,582 | 11/1894 | Beaman | 273/131 F |
| 3,724,856 | 4/1973 | Welch | 273/131 F |

*Primary Examiner*—Delbert B. Lowe
*Attorney, Agent, or Firm*—Harvey C. Nienow

[57] ABSTRACT

A game board having a generally rectangular or square playing surface whereon hexagonal spaces are contiguously arranged along axes at right angles to each other and along an axis at 45° to each of the other axes.

Each such hexagonal space is elongated along a longitudinal axis which intersects a pair of opposite sides, said opposite sides being shorter than the other four sides of the hexagonal space. The spaces may be provided with different colors to distinguish them, as desired.

8 Claims, 2 Drawing Figures

CHESS GAME APPARATUS

The present invention relates generally to game boards, but more particularly to boards which are used in the playing of chess-like and checker-like games.

Over the years, the game of chess, which is played on what is commonly known as an ordinary checkerboard, has become exceedingly popular. International tournaments as well as many local and regional tournaments are held regularly, and the skill involved in playing the game of chess is considerable.

Such chess game has been played on an ordinary checkerboard which is generally square in construction, having generally square spaces arranged in contiguous fashion on the playing surface in the form of a large square.

It has been the desire for some period of time to provide a game which is like the ordinary game of chess, but which is even more fascinating and challenging. Such game would involve not only the usual moves permissible with ordinary chessmen on an ordinary checkerboard, but would also include other dimensional moves as well. That is, whereas on an ordinary checkerboard, playing pieces or chessmen are able to move in relatively uncomplicated patterns, the new game would have additional directions of movement for the playing pieces.

It is an object of the present invention to provide a game board which is formed of similar or identical hexagonal spaces arranged in a generally square or rectangular configuration or format.

Another object of the present invention is to provide a game board as characterized above wherein the board itself is generally square or rectangular, and the playing surface thereon is composed of hexagonal spaces which are distorted from the usual or regular hexagon so as to enable contiguously arranged hexagonal spaces to have side-by-side relation along axes which are disposed at 90° to each other and along an axis which is at 45° to each of such other axes.

An even further object of the present invention is to provide a game board as characterized above wherein each of the hexagonal spaces is elongated along an axis which extends transversely of a pair of opposite sides, such sides being shorter in length than the remaining sides of the hexagonal space.

An even further object of the present invention is to provide a game board as characterized above which is simple and inexpensive to manufacture, and which is rugged and dependable in use.

Figure 1:
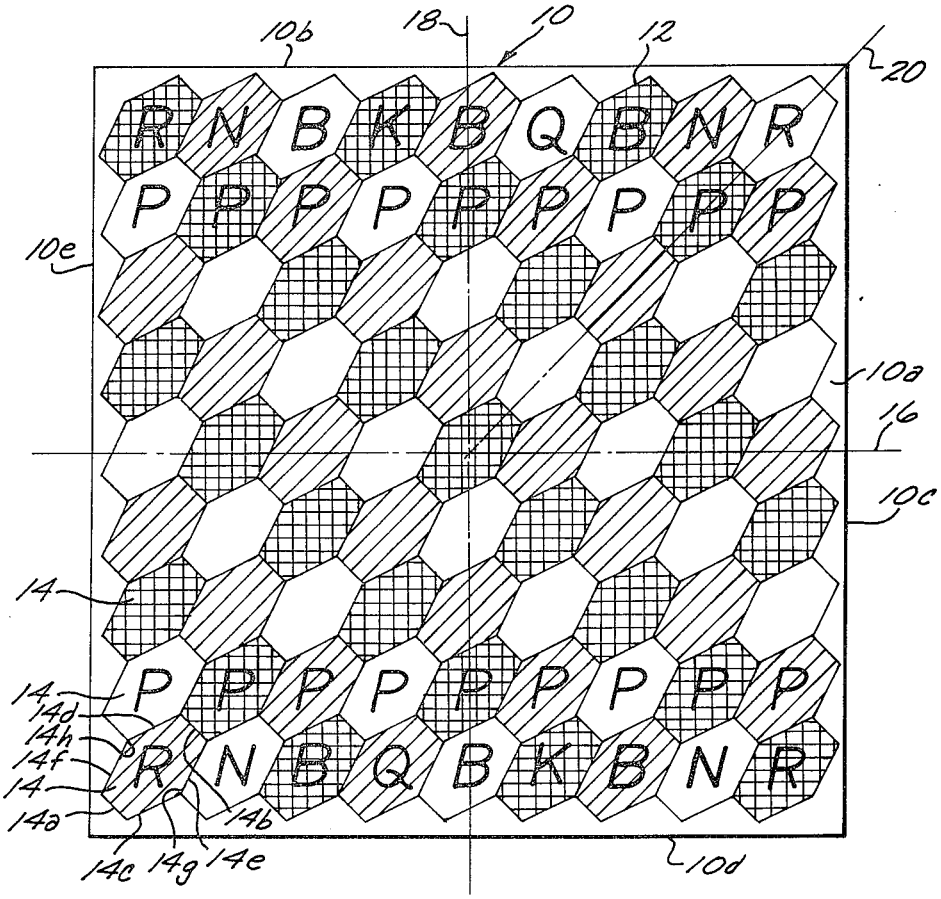
Figure 2:
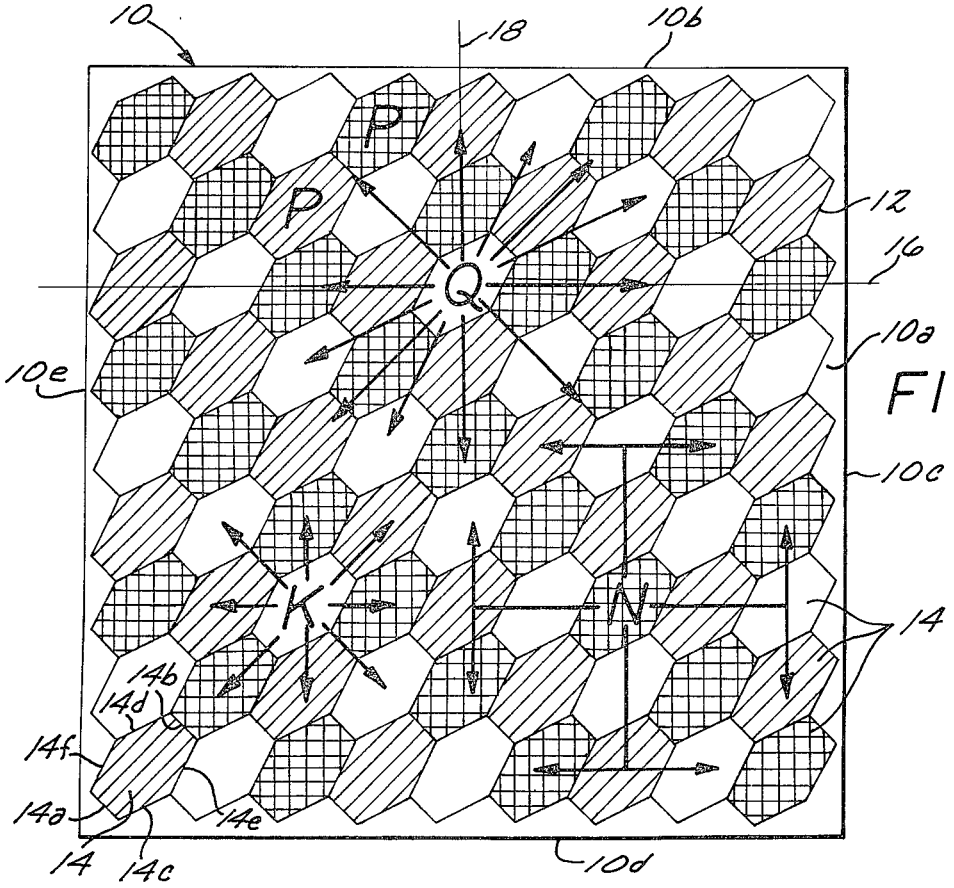

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a top plan view of the playing surface of a game board according to the present invention; and FIG. 2 is a similar top plan view of the playing surface, showing possible moves of some of the chesslike pieces to be used in a game.

Like reference characters indicate corresponding parts throughout the several views of the drawings.

Referring to FIG. 1 of the drawings, there is shown therein a generally rectangular game board 10 having a playing surface 10*a*. The four peripheral edges 10*b*, 10*c*, 10*d* and 10*e* of game board 10 are relatively straight and are joined to each other at substantially right angles to cause the game board 10 to be square or rectangular.

Such board may be formed of any one of a variety of materials such as paper, cardboard, wood, cloth and the like. It may have substantially any appropriate thickness since it is merely to be placed upon a flat surface such as a table top, the entire game being played on the game surface formed on the playing surface 10*a*. Also, as will be readily apparent to those persons skilled in the art, the board 10 may be hinged to be folded as desired for reasons of compactness during storage and transportation.

The playing surface 10*a*, as shown in the drawings, is affixed with a configuration 12 comprising a plurality of individual hexagonal spaces as shown at 14. The hexagonal spaces are identical in size and shape, and are uniquely formed to enable the six-sided spaces to be arranged in the square configuration shown.

Each hexagonal space 14 is provided with six sides 14*a*, 14*b*, 14*c*, 14*d*, 14*e* and 14*f*. Such sides are arranged in pairs of opposite sides, the sides 14*a* and 14*b* constituting one pair of opposite sides, the sides 14*c* and 14*d* comprising another pair of opposite sides and the sides 14*e* and 14*f* constituting a third pair of opposite sides.

Each such hexagonal space is elongated along an axis which intersects at right angles the sides 14*a* and 14*b*. Also, the sides 14*a* and 14*b* are shorter than the remaining sides 14*c*, 14*d*, 14*e* and 14*f* of the hexagonal space. Thus, each of the opposite included angles 14*g* and 14*h* is greater than any one of the remaining four included angles. To maintain the regularity of the shape of each hexagonal space, the included angles 14*g* and 14*h* are substantially identical, while the remaining four included angles are identical to each other.

The amount of distortion in each hexagonal space as compared to what is usually termed a hexagon, namely, the amount of elongation given to each space and the amount of shortening of the sides 14*a* and 14*b*, are determined by what is necessary to cause the hexagonal spaces to be arranged in quadrangular fashion as shown. That is, such distortion must be such as to enable the spaces to be contiguously arranged so that adjacent spaces have their sides 14*e* and 14*f* in side-by-side or coincidental relation, their sides 14*d* and 14*c* in side-by-side or coincidental relation and their sides 14*b* and 14*a* in side-by-side or coincidental relation. This provides a pattern or configuration in which there are no voids and wherein the direction of movement of playing pieces can be at right angles or along a 45° line as shown by axes 16, 18 and 20.

Referring again to FIG. 1 of the drawings, the playing surface is shown such that the various hexagonal spaces are cross-hatched for different colors. That is, any appropriate distinguishing colors may be employed to cause the spaces to stand out more strongly. For instance, the blank space could be white, the parallel lined space could be yellow, and the square cross-hatched space could be red. In this way, any moves made on the playing surface could be quickly and easily visualized.

A chess-like game employing many of the playing pieces used today in playing the game of chess is shown in FIG. 1. Starting from the lower left hand corner and reading to the right, the letter "R" stands for a rook or castle, "N" stands for knight, "B" stands for bishop and "Q" stands for queen. The letter "K" stands for a king and an additional bishop "B" is placed between the queen and king.

The next row of the playing surface is occupied with pawns (P).

These chess-like pieces are merely exemplary of various types of pieces which can be employed in substantially any type of game desired. However, referring to FIG. 2, it is seen that each of such chess-like pieces is afforded a great many additional moves, over the usual moves encountered in the chess game on an ordinary checkerboard. For instance, the queen (Q) shown in FIG. 2 (reference being had to the arrows emanating therefrom) can move in any one of twelve directions. That is, the queen can move along either a vertical or horizontal axis or along either of the 45° axes as laid on the board. In addition, it is possible to afford the queen (Q) with two other axes of movement namely axes that extend along the adjacent edges of the hexagonal spaces, as shown.

Also shown in FIG. 2 are movements which may be afforded the king (K). The king is shown as having movement in eight different directions, along axes which are vertical and horizontal on the board as well as axes at 45° thereto.

Also shown on FIG. 2, are movements which could be afforded the knight (N) . Here, in typical chess-like movement, the knight is permitted to move two spaces in one direction and one space at right angles thereto. Although not shown in FIG. 2 of the drawings, the reverse movement is also afforded the knight, namely movement only one space from its initial position and then two spaces at right angles thereto, in either event the final position being the same.

It is thus seen that the unique game board affords the playing of various different types of games, including chess-like and checker-like games. However, the complexities and hence challenges in such games played on this three-dimensional board are heightened and therefore make for a more exciting game.

Although I have shown and described certain specific embodiments of my invention, I am well aware that many modifications thereof are possible.

I claim:

1. A game comprising in combination, a game board having a playing surface, a playing configuration formed on said surface comprising contiguously arranged hexagonal spaces each side of which is aligned with the corresponding side of other spaces along axes at 90° or 45° to each other, and two sets of playing pieces, each set of which comprises a king, a queen, three bishops, two knights, two rooks, and nine pawns, all of the pieces in each set having indicia of only the respective set of pieces.

2. A game according to claim 1, wherein said hexagonal spaces are arranged in rows forming a rectangular configuration.

3. A game according to claim 2, wherein each pair of opposite sides of each hexagonal space are aligned along an axis which is disposed at 90° or 45° to the axis of alignment of each other pair of opposite sides of the respective hexagonal spaces.

4. A game according to claim 3, wherein the sides of each pair of opposite sides of each hexagonal space are parallel to each other.

5. A game according to claim 4, wherein each hexagonal space is formed with one pair of opposite sides which are shorter than the sides of the other of said pairs of opposite sides.

6. A game according to claim 5, wherein each hexagonal space is elongated along a longitudinal axis at right angles to both said shorter opposite sides.

7. A game according to claim 6, wherein said longitudinal axis of each hexagonal space is disposed at 45° to one edge of said board.

8. A game according to claim 7, wherein the length of each of said shorter sides and the amount of elongation of said hexagonal space combine to cause the sides of said other pair of opposite sides to be aligned along axes at right angles to each other and which parallel adjacent edges of said game board.

* * * * *